United States Patent [19]

Grutter et al.

[11] Patent Number: 4,832,502

[45] Date of Patent: May 23, 1989

[54] AGITATION SUPPORTING AND DRIVING MEANS FOR COMMERCIAL FOOD MIXERS AND THE LIKE

[75] Inventors: William G. Grutter; Paul J. Koepnick, both of Grand Rapids, Mich.

[73] Assignee: APV Baker, Inc., Grand Rapids, Mich.

[21] Appl. No.: 108,938

[22] Filed: Oct. 13, 1987

[51] Int. Cl.[4] ..... B01F 7/02

[52] U.S. Cl. ..... 366/279; 74/665 GA; 74/665 GE; 366/185

[58] Field of Search ..... 366/279, 298, 299, 300, 366/301, 331, 64, 66, 184, 185, 187, 189, 194, 264, 296, 297, 299, 300, 287, 288, 45, 46; 74/665 GE, 665 GA

[56] References Cited

U.S. PATENT DOCUMENTS

| | | | |
|---|---|---|---|
| 1,845,367 | 2/1932 | Totman | 366/46 |
| 2,596,672 | 5/1952 | Gard et al. | 366/187 |
| 2,808,239 | 10/1957 | Reiffen | 74/665 GA |
| 3,100,064 | 8/1963 | Kacena | 366/185 |
| 4,147,331 | 4/1979 | Kopecky | 366/46 |
| 4,172,712 | 10/1979 | Heller | 366/301 |
| 4,447,158 | 5/1984 | Simon | 366/297 |

*Primary Examiner*—Robert W. Jenkins

*Attorney, Agent, or Firm*—Price, Heneveld, Cooper, DeWitt & Litton

[57] ABSTRACT

Means for supporting and driving agitators in commercial food mixers and the like as disclosed herein include structure for mounting and supporting the agitator(s) separately from the structure which rotatably supports the mixing bowl. The mixing bowl has a pair of spaced ends and is rotatably supported by trunnions fixed to such spaced ends and extending outwardly therefrom toward adjacent support frame members which have journals for rotatably cooperating with such trunnions to thereby support the mixing bowl. The agitator for the mixer is journaled in the spaced ends of the mixing bowl, such that the weight of the mixing bowl and the mix therein is not imparted to the agitator shaft. Preferably, th agitator is rotatably driven by drive-transmission means including drive gears disposed outside the mixing bowl and outboard of the support frame members but generally in alignment with the agitator shaft, and flexible drive means (e.g., V-belts or the like) interconnect such drive gears and a motor located at a position spaced from the agitator axis, e.g., at floor level. In the most preferred embodiment, the trunnion means for rotatably supporting the mixer bowl comprises a rigid cylinder which is also utilized as the housing for the agitator drive gearing, whereby the mixer bowl support and rotational mechanism is integrated with, but separate from, that of the agitators.

17 Claims, 3 Drawing Sheets

AGITATION SUPPORTING AND DRIVING MEANS FOR COMMERCIAL FOOD MIXERS AND THE LIKE

TECHNICAL BACKGROUND

This invention relates generally to food-processing machinery, particularly of the large, relatively massive type used in commercial food-processing operations, and more particularly relates to agitator-type mixing machines utilized in commercial food-processing operations. Still more particularly, the invention relates to rotational mounting and drive train apparatus and systems used in such mixers, for rotatably driving the agitator elements through the various ingredients constituting the mass which is to be mixed.

BACKGROUND OF THE INVENTION

Commercial food-ingredient mixing apparatus is typically massive and powerful in nature, since such machines are usually required to vigorously mix, and frequently to "develop," a thick mass of ingredients, which may be either viscous or dry. This is accomplished by briskly rotating various types of agitator blades through the mass, a process requiring substantial amounts of horsepower and rigid, high-strength agitators. Correspondingly, the drive mechanisms for such mixers have typically been of a similarly massive and high-strength nature, usually involving heavy-duty, metal drive chains extending between a double gearbox setup, one such gearbox being at the power input (i.e., motor) point, and the other being at the agitator drive shaft locations.

Such conventional systems have thus utilized at least two gearboxes, and with the presence of the aforementioned mechanical drive chain, such systems obviously necessitated substantial lubrication of the moving, heavily-loaded drive chain. Consequently, such drive systems have necessitated the presence of substantial quantities of lubricant for the mechanical drive components, and such lubricant had to be located immediately adjacent the area where food-mixing takes place, thereby inevitably raising the prospect of contamination and the corresponding requirement of extensive sealing provisions and lubricant barriers to prevent contamination of the mix. Of course, such chain-type drive systems also involve the presence of high noise levels, involving substantial metal-to-metal contact and continuously-rotating parts. Additionally, such chain-type drive trains in effect established a rigid link between the drive motor and the agitators, thereby imposing all of the shock, impact, and jerk which is experienced by the agitators themselves directly back upon the drive motor, and through the drive train, thereby increasing the potential of breakdown and magnifying the effects of wear and tear.

BRIEF SUMMARY OF THE PRESENT INVENTION

The present invention provides a new and novel concept for power trains in the general field referred to above, i.e., commercial food-processing mixer applications, by which the conventional mechanical drive chain is eliminated, as is the need for the double gearbox arrangement mentioned above. Additionally, the power train of the invention provides the capability of double distribution (i.e., dual agitator actuation i.e., drive) with integral speed reduction and gear ratio change. Further, the invention provides a new and advantageous mounting and supporting structure and arrangement for the mixing bowl and agitator components, which facilitates use of the new drive train just noted.

Accordingly, the power train in accordance with the invention eliminates certain prior art components and assemblies, while varying the nature of others, thereby achieving reduced operating noise levels, reduced power losses, fewer moving parts, less maintenance, smoother operation with improved motor isolation, at the same time requiring less space and expense than prior art apparatus.

Additionally, and of considerable significance, the apparatus in accordance with the invention eliminates the need for exposed oiling or similar lubrication of the drive chain in the area adjacent the mixing bowl and agitators, thereby substantially improving environmental cleanliness and reducing the likelihood of contaminating the edible products being mixed.

Basically, the mounting and supporting structure and power train in accordance with the invention comprises a single speed-reduction means having dual counter-rotating outputs, which receives its rotational drive directly from the drive motor through resilient drive belts, i.e., V-belts, for example by a series (e.g., three) of adjacent, parallel V-belts driving a common pulley from a single drive motor output shaft. Further, the structure contemplated involves utilization of the speed-reduction means as part of the rotational support and mount for the mixing bowl. Such an arrangement has numerous advantages, as detailed above, and provides a form of drive which has, so far as is known, been considered for use heretofore inasmuch as conventional thinking would not, as a general matter, have deemed V-belt-type drives suitable for the high-torque, slow-speed environment encountered in commercial food-mixing apparatus.

DESCRIPTION OF PREFERRED EMBODIMENTS

Figure 1:
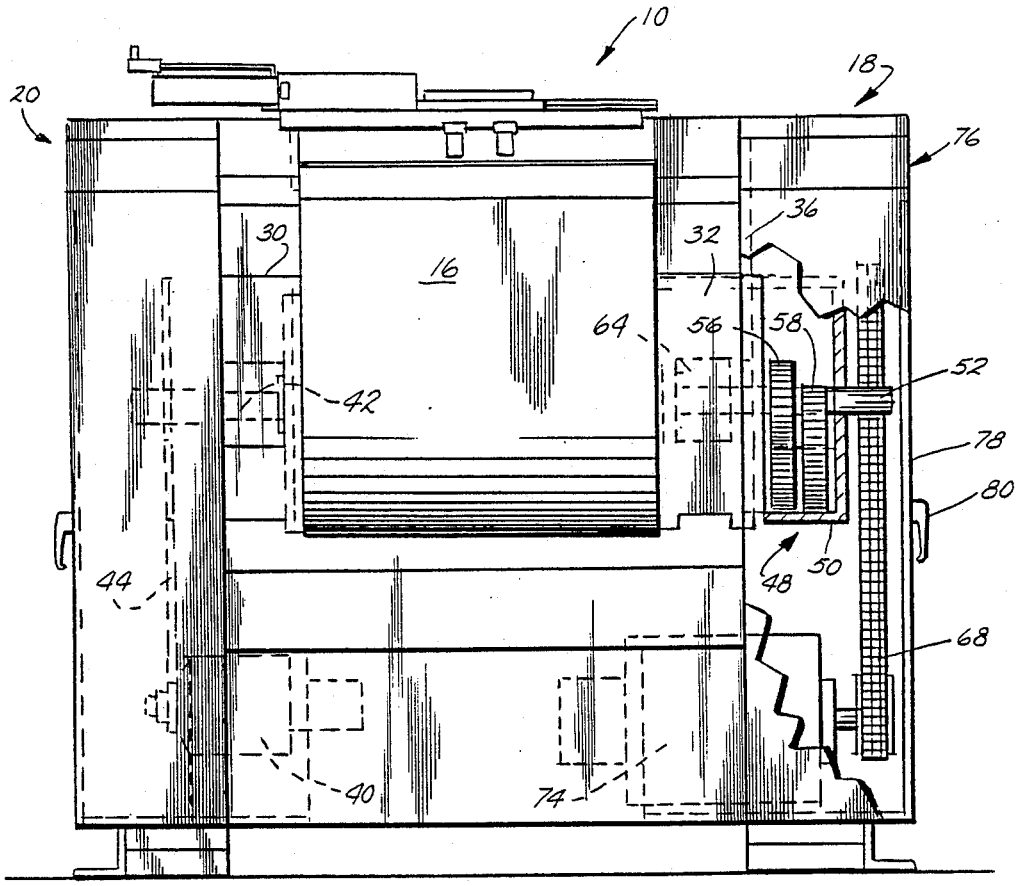
FIG. 1 is a simplified, side-elevational view of a mixing apparatus embodying the apparatus of the present invention.
Figure 2:
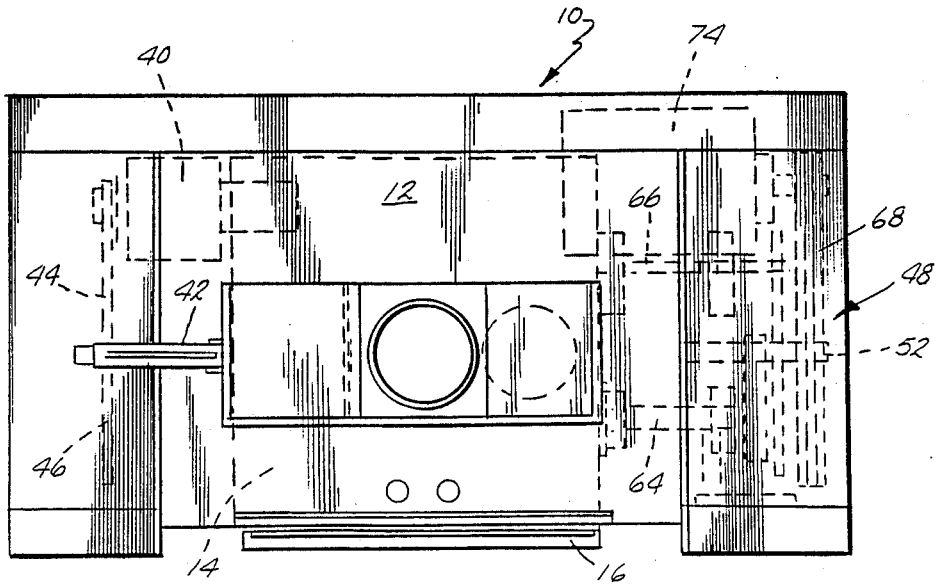
FIG. 2 is an overhead plan view thereof.

The overall nature and structure of a preferred type of commercial food-mixer apparatus for advantageous employment of the invention is illustrated in FIGS. 1, 2, 3 and 5, wherein the same is designated by the numeral 10. As there illustrated, the mixer 10 generally comprise a mixing bowl assembly 12, comprising a concave trough-like mixing bowl 14 and a complementary-shaped insulating cover or shield 16, which laterally encloses the two curved sides and bottom of the mixing bowl 14 (as described more fully hereinafter). The mixing bowl 14 extends generally horizontally and is supported in position upon upright frame or housing assemblies 18 and 20 by trunnions, as described more fully hereinafter.

Generally speaking, the bowl assembly 12 includes at least one, and in this preferred embodiment two, horizontally-extending agitators (not specifically illustrated), preferably of the type illustrated in co-pending application Ser. No. 007,517, filed Jan. 28, 1987, which in cross section occupy the circular space indicated at 22 and 24 in FIGS. 3 and 4. As will be seen, the structure and methodology for mounting and rotating the mixing bowl and agitators is the subject matter toward which this particular patent is directed.

Figure 3:
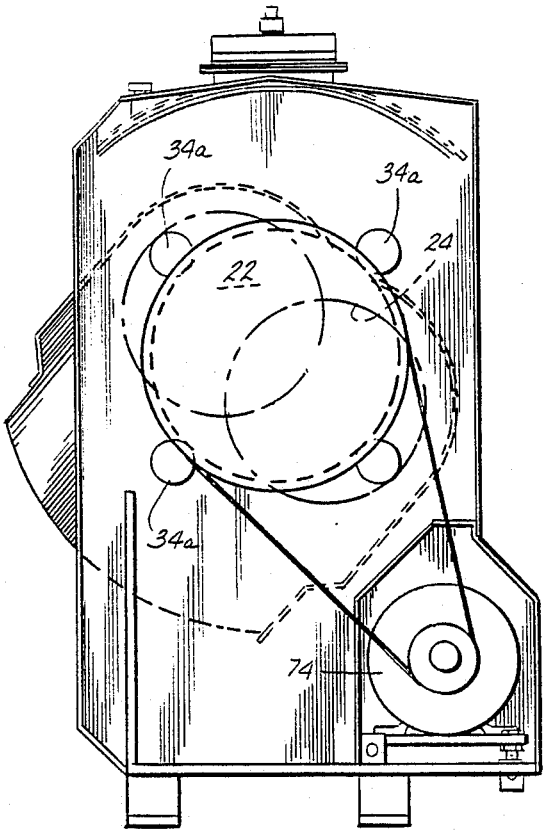
FIG. 3 is an end elevational view thereof, as seen from the right in FIG. 1, but showing the mixing bowl in an alternative (rotated) position.
Figure 7:
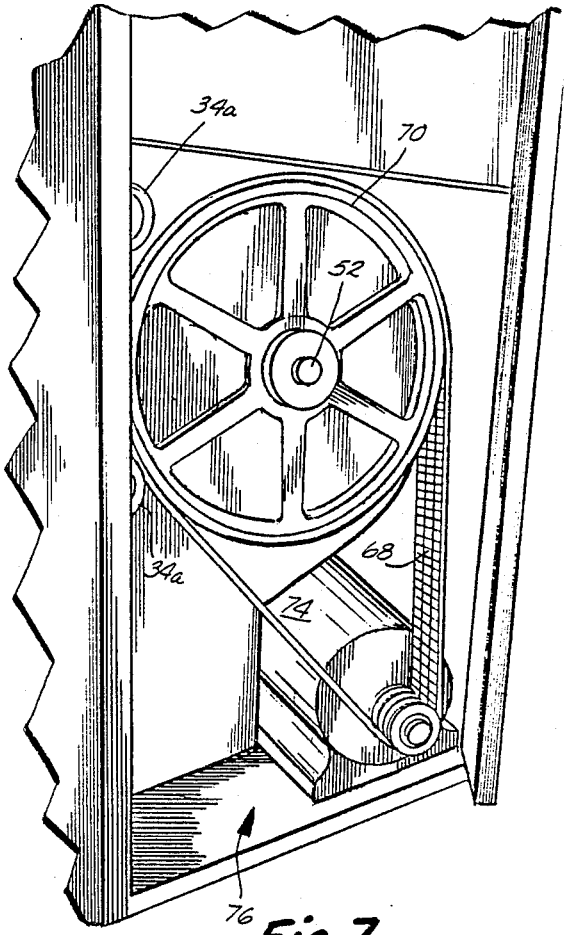
FIG. 7 is a fragmentary, perspective view of the end of the apparatus shown in FIG. 3, illustrating other aspects thereof.
Figure 4:
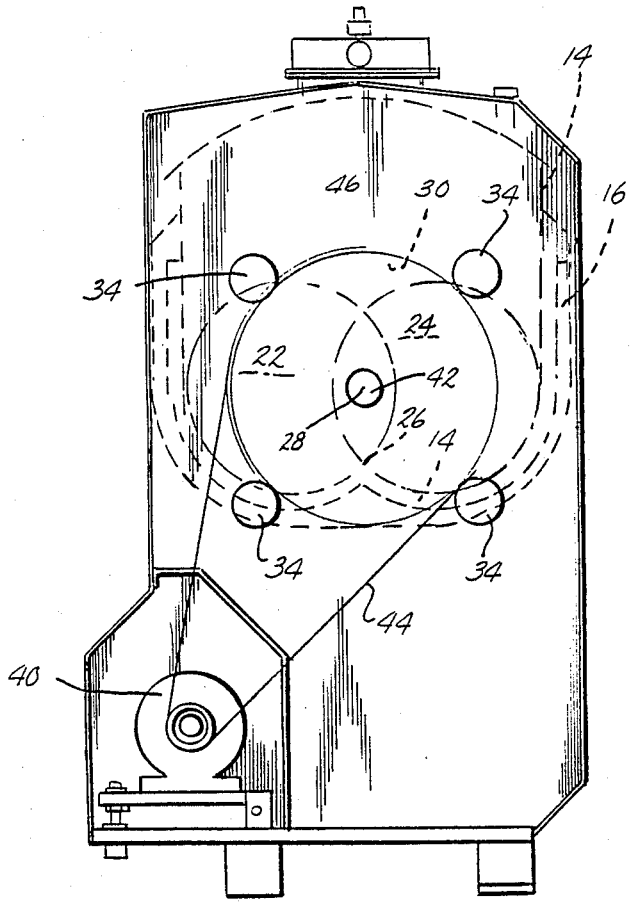
FIG. 4 is an end elevational view thereof, as seen from the left in FIG. 1.

The bowl 14 in the illustrated embodiment comprises an open-topped trough-like vessel whose bottom is preferably shaped to complement the rotational envelope of the agitators (22, 24) disposed for operation therewithin. While a single agitator may be used in carrying out the invention, the present preferred embodiment illustrates the use of a pair of agitators disposed in side-by-side relation (as illustrated in FIGS. 3 and 4), with portions of one agitator moving through the silhouette or rotational envelope of the other. In this embodiment, the bottom extremity of the bowl 14 has the general shape of a cardioid, defining a longitudinally-extending upraised central ridge 26 between the two rounded portions which complement the shape of the dual agitator envelope.

The mixing bowl 14 is supported between the frame or housing portions 18 and 20 for rotation about a longitudinal axis 28, in the manner illustrated by comparing Figs. 3 and 4. Structurally, the mixing bowl 14 is supported by trunnion tubes 30 and 32, comprising rigid tubular support members of right-cylindrical shape. Trunnion tubes 30 and 32 are rotatably supported in position upon support wheels 34, **34*a*, respectively, which are mounted upon rigid upright support walls 36 and 38 comprising part of the frame or housings 18 and 20, respectively. Accordingly, the entire bowl assembly 12 is pivotal about an axis 28, by rotation of the bowl support trunnion tubes 30 and 32 upon their corresponding support wheels 34, 34*a*, to thereby move between the upright position illustrated in FIGS. 1 and 4, in which mixing occurs, and the unloading position shown in FIG. 5, in which the bowl is tilted so that its contents may be removed after mixing has been completed. Such tilting rotation of the mixing bowl assembly is controlled and brought about by a motor 40 (FIGS. 1, 2 and 4) which is coupled to a bowl-tilt shaft 42 by a drive chain 44 and sprocket 46, which is mounted on shaft 42**.

Figure 6:
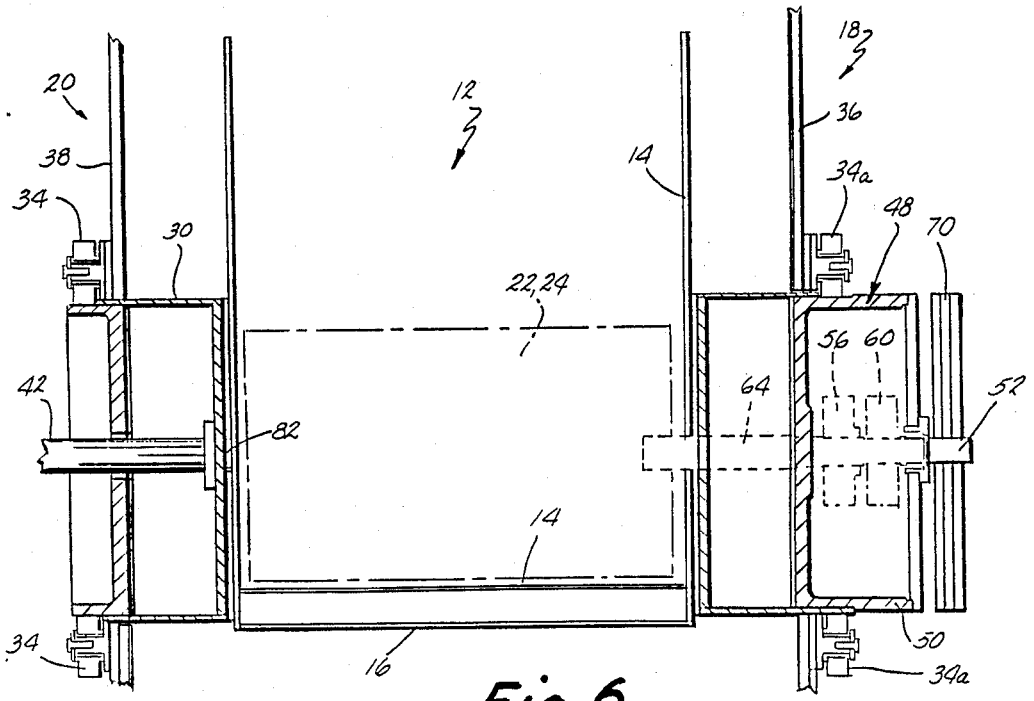
FIG. 6 is a fragmentary, side-elevational view of a portion of the apparatus shown in FIG. 1, showing certain attributes thereof in more detail.

As already indicated, the right-hand side of the bowl assembly 12 is also rotatably supported, and incorporates a trunnion tube (32) and trunnion tube support wheels **34*a*; however, in accordance with the invention this side of the bowl assembly also includes a gear head or transmission 48 (FIGS. 1, 2, 3 and 6), which has a cylindrical outer case or housing 50 that in effect constitutes an annular extension of the bowl support trunnion tube 32 and is rigidly secured thereto. Consequently, the support wheels 34*a* mounted upon upright support wall 36 in fact support the bowl assembly 12 by contact with the case 50 of gear head 48, rather than with the trunnion support tube 32 (FIG. 6**).

Figure 5:
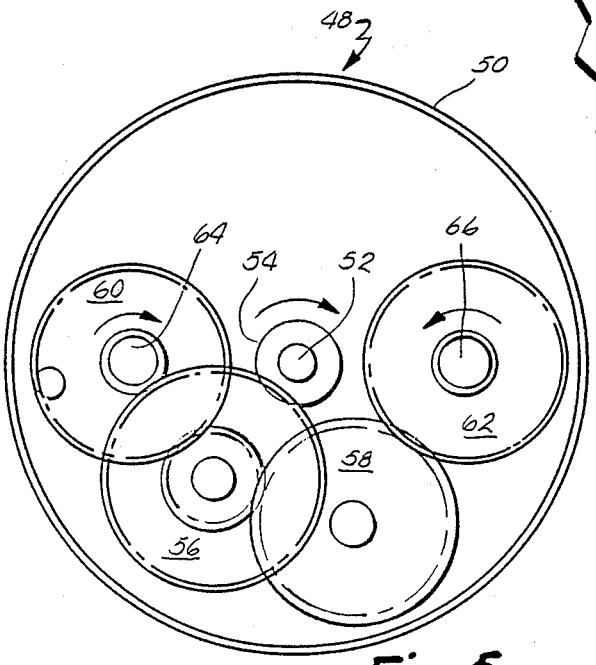
FIG. 5 is an enlarged, simplified, end elevation of the gear train used in a preferred embodiment.

The gearbox 48 includes a series of internal gears (e.g., spur gears), as illustrated in FIG. 5, such that an input supplied on a central drive shaft 52, which is splined into or otherwise secured to a drive gear 54, is substantially reduced in speed by transmission through mating gears 56, 58, 60 and 62 and ultimately supplied as a pair of counter-rotating outputs (as indicated by the arrows) on a pair of output shafts 64 and 66 driven by the final gears 60 and 62, respectively. As may be seen in FIGS. 1, 2, 3 and 4, for example, the counter-rotating output shafts 64 and 66 are coupled to the drive shafts (e.g., extended end portions of) the agitators within the bowl 14 whose position and rotational envelope is designated by the numerals 22 and 24.

In accordance with the invention, the power input to the central drive shaft 52 of gearbox or transmission 48 is applied through a series of adjacent, parallel V-belts 68 which extend between a large-diameter multiple-groove pulley wheel 70 mounted on input drive shaft 52 and a corresponding small-dimension multiple-groove drive pulley 72 mounted on the output shaft of an electric motor 74. Drive belts 68 may be of a typical commercial nature, having a V-shaped configuration and riding in complementary-shaped grooves in pulleys 70 and 72. While perhaps not necessary in most applications, drive belts 68 may be of the cross-ribbed or cleated type which provide increased pulling power and decreased likelihood of slippage; in most instances, however, typical smooth-surfaced V-belts will be sufficient. As will be understood, all such belts are preferably at least somewhat resilient in character, and have a composite elastomeric-and-fiber content, such as are widely available through numerous sources.

As will be appreciated by those skilled in the art, the drive train and mounting structure thus described has very different components and operational characteristics than the conventional metal chain-and-sprocket, double-gearbox type of drive which has, so far as is known, been used in essentially all such instances heretofore. From the standpoint of componentry and mechanical complexity, the present drive train is greatly simplified from that known and used in the past, and in fact eliminates one complete gearbox found in state-of-the-art conventional mixers, which is typically located at or very near the position of drive motor 74. With this change, the entire area surrounding the drive mechanism (e.g., within the frame and housing 18, which preferably includes a cabinet-like enclosure 76 having a hinged door 78 with an operating handle 80) is clean and dry, being devoid of oil, grease, and the like.

That is, while gearbox 48 does preferably include a supply of appropriate lubricant for the gears 56, 58, etc., gearbox 48 may be readily sealed so that its internal lubricant is wholly self-contained, thereby eliminating likelihood of contamination with the mix batch. More to the point, the resilient drive belts 68 do not require lubrication, and run dry on the corresponding pulleys 70 and 72. Not only does this eliminate an oily and messy area, it also eliminates substantial noise, since the drive belts 68 run much more quietly than the characteristic metal chain and sprocket drive. Further, resilient drive belts such as those employed in accordance with the invention provide a much higher degree of isolation between the drive motor 74 and the agitators within the mixer, which are under substantial shock and strain in many different operational environments. Furthermore, use of the disclosed double-drive gearbox 48 not only eliminates one of the two gearboxes typically used, as described heretofore, but also provides gear reduction at the same point as drive distribution, i.e., it provides a pair of separate, counter-rotating drive outputs.

As may be appreciated from the foregoing disclosure, the case or housing 50 of gearbox 48 actually performs a double function, acting as an extension of the agitator bowl-support trunnion, and in fact rotating during tilting of the mixing bowl as described above in conjunction with FIGS. 3 and 4. Of course, during such tilting motion of the bowl the agitators within the bowl rotate with it, such that their input drive shafts 64 and 66 rotate around the gearbox input shaft 52 as an axis, with corresponding rotation of the various gears in the gear train illustrated in FIG. 5. In this connection, it will be understood that the agitators are mounted for rotation upon the end wall of the mixing bowl 14 adjacent the agitator ends located opposite agitator drive shafts 64 and 66, as generally illustrated and indicated at 82 in FIG. 6. The end portion of the agitators which carry shafts 64 and 66 may be supported at least in part by the gearbox housing 50; that is, agitator shafts 64 and 66 may be received in bearings (not specifically illustrated or designated) mounted in the gearbox walls through which shafts 64 and 66 extend, the gearbox housing 48 being rigidly secured with respect to end wall 36 and bowl support trunnion 32.

In accordance with the foregoing disclosure, it may be appreciated that the invention comprises not only a new and different drive train per se for mixers and the like, but in addition provides a new and novel mounting arrangement and structure for the mixing bowl and agitators, complementing the new form of drive train. The advantages and desirability of such apparatus will no doubt be apparent to those skilled in the art, as will the advantages of the overall aspects of the invention, including the drive train per se.

It is to be understood that the above detailed description is merely that of one exemplary preferred embodiment of the invention, and that numerous changes, alterations and variations may be made without departing from the underlying concepts and broader aspects of the invention as set forth in the appended claims, which are to be interpreted in accordance with the established principles of patent law, including the doctrine of equivalents.

The embodiments of the invention in which an exclusive property or privilege is claimed are defined as follows:

1. Agitator supporting and driving means for commercial food mixtures and the like, comprising in combination: a mixing bowl; at least one agitator and means for mounting and supporting said agitator for rotation within said bowl; said agitator having a driving shaft extending out of said bowl, for imparting rotation to said agitator; a speed-reduction means disposed outside said bowl, said speed-reduction means having at least one rotary output member; means for connecting said agitator shaft to said rotary output member for rotatably driving the agitator; said speed-reduction means having a rotary input member for receiving drive actuation from a source thereof; a motor for supplying rotary drive power; and drive-transmitting means extending between said input member and said motor for coupling the same together such that said motor rotatably drives said input member; at least one of said drive-transmitting means and said means for connecting said agitator shaft to said rotary output member comprising at least one generally flexible drive belt means; said mixing bowl having a pair of spaced ends; and means separate from said agitator and from its mounting and supporting means for pivotally mounting and supporting said bowl independently of said agitator on an axis extending through said spaced ends; said mounting and supporting means including support frame members disposed generally adjacent each of said spaced bowl ends and trunnion means comprising a rigid cylindrical member fixed to each of said spaced ends and extending outwardly therefrom toward said support frame members, said support frame members having journal means for rotatably supporting said trunnion and thus said bowl.

2. Agitator means according to claim 1, wherein said speed-reduction means is disposed adjacent the location of said agitator driving shaft outside said bowl.

3. Agitator means according to claim 2, wherein said speed-reduction means output member is directly-coupled to said agitator driving shaft, and wherein said drive belt extends between said speed-reduction means input member and said motor.

4. Agitator means according to claim 2, wherein said speed-reduction means comprises a gearbox having a rotary input shaft, and wherein said input member comprises a shaft and pulley member, said flexible belt being entrained over said pulley member to rotate the same and thereby rotate said shaft.

5. Agitator means according to claim 1, wherein said drive belt has a tapered cross section and is one of the general type known as a V-belt.

6. Agitator means according to claim 1, wherein said flexible belt means comprises a series of generally parallel and adjacent belt members.

7. Agitator means according to claim 1, wherein said flexible belt means is driven substantially directly by said motor without speed-reduction means disposed therebetween.

8. Agitator means according to claim 1, wherein said speed-reduction means has a rotary input member and a pair of rotary output members for separately driving a pair of agitators, and wherein said at least one agitator comprises a pair of separate agitator members each disposed within said bowl.

9. Agitator means according to claim 8, wherein said speed-reduction means is disposed generally in alignment with the axes of said agitators but located outside said mixing bowl.

10. Agitator means according to claim 8, wherein each of said agitators in said pair thereof has a separate driving shaft and each such shaft extends out of said bowl, and wherein said means for connecting said at least one agitator shaft to said at least one rotary output member of said speed-reduction means is arranged to separately connect each such agitator driving shaft to a different one of said rotary output members, said speed-reduction means in said pair thereof

11. Agitator means according to claim 10 wherein each of said speed-reduction means output members is directly coupled to its corresponding agitator driving shaft, said drive belt extending between said speed-reduction means input member and said motor.

12. Agitator means according to claim 11, wherein said flexible belt means is at least stiffly resilient in nature and comprises a composite of rubber-like and fiber-like components.

13. Agitator means according to claim 1, wherein said speed-reduction means is disposed adjacent the location of said agitator driving shaft outside said bowl and is mounted generally in axial alignment with said pivot axis of said bowl.

14. Agitator means according to claim 13, wherein said speed-reduction means includes housing portions which cooperate with said trunnion means and said journal means in pivotally supporting said bowl.

15. Agitator means according to claim 14, wherein said speed-reduction means is secured to one of said spaced sides of said bowl for pivotal movement therewith.

16. Agitator means according to claim I5, wherein said housing portions of said speed-reduction means comprise part of the support trunnion for said bowl.

17. Agitator means according to claim 1, wherein said journal means comprise a plurality of mutually-spaced roller members mounted on said support frame members and disposed about the periphery of said cylindrical member and in contact therewith to rotatably support such member and thus said bowl.

* * * * *